US012075924B2

(12) United States Patent
Yang

(10) Patent No.: US 12,075,924 B2
(45) Date of Patent: Sep. 3, 2024

(54) FOLDABLE SMALL DINING CHAIR

(71) Applicant: TJ (fujian) Industrial Co., Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 351 days.

(21) Appl. No.: 17/709,477

(22) Filed: Mar. 31, 2022

(65) Prior Publication Data

US 2022/0386786 A1 Dec. 8, 2022

(30) Foreign Application Priority Data

Jun. 3, 2021 (CN) ..... 202121230120.2

(51) Int. Cl.
*A47D 1/02* (2006.01)
*A47D 1/00* (2006.01)

(52) U.S. Cl.
CPC ..... *A47D 1/02* (2013.01); *A47D 1/0085* (2017.05)

(58) Field of Classification Search
CPC ..... A47D 1/023; A47D 1/002
USPC ..... 297/148, 35
See application file for complete search history.

(56) References Cited

U.S. PATENT DOCUMENTS 6,347,830 B1 * 2/2002 Chen ..... E06C 1/32 297/344.14
7,490,895 B2 * 2/2009 Yeh ..... A47D 1/002 297/50
2022/0386785 A1 * 12/2022 Yang ..... A47D 1/023
2023/0117630 A1 * 4/2023 Yang ..... A47D 1/0085 297/127

* cited by examiner

*Primary Examiner* — Sarah B McPartlin
(74) *Attorney, Agent, or Firm* — Bayramoglu Law Offices LLC

(57) ABSTRACT

A foldable small dining chair includes a front support frame and a rear support frame which are arranged in a foldable manner. The front support frame is provided with a left sleeve member and a right sleeve member. The front support frame is provided with a left armrest connecting rod and a right armrest connecting rod. A top front end of the left armrest connecting rod is provided with a foldable left armrest, and a top front end of the right armrest connecting rod is provided with a foldable right armrest. A rotatable seat is provided between the left sleeve member and the right sleeve member. A dining tray being detachable and movable forwards and backwards is provided between the left armrest and the right armrest. A detachable backrest is provided between the left armrest connecting rod and the right armrest connecting rod.

12 Claims, 17 Drawing Sheets

FOLDABLE SMALL DINING CHAIR

CROSS REFERENCE TO THE RELATED APPLICATIONS

This application is based upon and claims priority to Chinese Patent Application No. 202121230120.2, filed on Jun. 3, 2021, the entire contents of which are incorporated herein by reference.

TECHNICAL FIELD

The present invention relates to the field of children's products, and more particularly, to a foldable small dining chair.

BACKGROUND

Highchairs are special dining chairs for children. Highchairs can help children develop the habit of sitting while eating and avoid the trouble of chasing a child for feeding. Children can sit steadily in a suitable highchair, and their hands can be freed to grasp tableware, which exercises the coordination of children's hands, eyes, and brain. The prior small dining chairs for children are relatively small in height, which can be placed directly on the ground to match a low dining table, or placed on an adult dining chair to match a normal dining table. However, they are not foldable and require large storage space.

SUMMARY

In order to solve the problem that the existing small dining chairs require large storage space, the present invention provides a foldable small dining chair.

To solve the above technical problem, the present invention adopts the following technical solution:

A foldable small dining chair includes a front support frame and a rear support frame, where the front support frame and the rear support frame are arranged in a foldable manner; the front support frame is provided with a left sleeve member and a right sleeve member; the front support frame is provided with a left armrest connecting rod and a right armrest connecting rod; a top front end of the left armrest connecting rod is provided with a foldable left armrest, and a top front end of the right armrest connecting rod is provided with a foldable right armrest; a rotatable seat is provided between the left sleeve member and the right sleeve member; a dining tray being detachable and movable forwards and backwards is provided between the left armrest and the right armrest; and a detachable backrest is provided between the left armrest connecting rod and the right armrest connecting rod.

Further, both the front support frame and the rear support frame may be U-shaped; each of top left and right ends of the front support frame may be provided with a front pivoting piece, and each of top left and right ends of the rear support frame may be provided with a rear pivoting piece; the front pivoting piece may be correspondingly hinged to the rear pivoting piece, and a first movement space may be formed after the front pivoting piece and the rear pivoting piece are connected correspondingly; an engaging member movable in left and right directions may be provided in the first movement space; the engaging member may be engaged with the front pivoting piece and the rear pivoting piece; and one side surface of the front pivoting piece may be provided with a first button for driving the engaging member to move.

Further, a plurality of engaging teeth may be provided on a periphery of the engaging member; the other side surface of the front pivoting piece may be provided with a first accommodating groove and a plurality of first engaging grooves distributed on a periphery of the first accommodating groove; the plurality of first engaging grooves communicate with the first accommodating groove; a side surface of the rear pivoting piece may be provided with a second accommodating groove and a plurality of second engaging grooves distributed on a periphery of the second accommodating groove; the plurality of second engaging grooves communicate with the second accommodating groove; the first accommodating groove and the second accommodating groove form the first movement space; the plurality of engaging teeth may be adapted to the plurality of first engaging grooves and the plurality of second engaging grooves; and in a use state, the plurality of engaging teeth are simultaneously engaged with the plurality of first engaging grooves and the plurality of second engaging grooves.

Further, a button groove adapted to the first button may be provided on one side surface of the front pivoting piece; the button groove may be provided with a plurality of through grooves communicating with the first accommodating groove; a plurality of pressing pieces may be provided on one side surface of the first button; each pressing piece corresponds to one through groove; a hook portion may be provided at an end of each pressing piece; each of the through grooves may be provided with an abutting edge portion; each pressing piece passes through a corresponding through groove, and the hook portion abuts against the abutting edge portion; the end of each pressing piece abuts against the engaging member; and a first spring may be provided between the engaging member and the second accommodating groove.

Further, the left sleeve member and the right sleeve member may be respectively provided with a left sleeve hole and a right sleeve hole; and a bottom of the left armrest connecting rod and a bottom of the right armrest connecting rod may be respectively nested in the left sleeve hole and the right sleeve hole.

Further, each of a front top end of the left armrest connecting rod and a front top end of the right armrest connecting rod may be provided with a hinge portion; each of a rear end of the left armrest and a rear end of the right armrest may be provided with a slit adapted to the hinge portion; the hinge portion may be located in the corresponding slit and hinged to the corresponding left armrest or right armrest; a front end surface of the hinge portion may be provided with a first insertion hole; each of a bottom of the left armrest and a bottom of the right armrest may be provided with an opening; the opening may be covered with a cover plate; each of the left armrest and the right armrest may be provided with a second movement space; a first movable member may be provided in the second movement space; a first insert portion may be provided at one end of the first movable member; the first insert portion passes through the corresponding left armrest or right armrest to be inserted into the corresponding first insertion hole; a bottom of the first movable member may be provided with a pressing plate; a bottom of the cover plate may be provided with a movement through-groove; and the pressing plate may be located in the movement through-groove.

Further, a first limiting post may be provided in the second movement space; the first movable member may be provided with a first elongated limiting groove; the first limiting post may be located in the first elongated limiting groove; and a second spring may be provided between a front end of the first movable member and a front inner wall of the second movement space.

Further, a bottom of the dining tray may be provided with a left guide groove and a right guide groove; a left sliding groove and a right sliding groove may be provided on one side surface of the left armrest and one side surface of the right armrest respectively; one side surface of the left guide groove and one side surface of the right guide groove may be provided with a left guide bar and a right guide bar respectively; an upper part of the left armrest and an upper part of the right armrest may be located in the left guide groove and the right guide groove respectively; the left guide bar and the right guide bar may be adapted to the left sliding groove and the right sliding groove respectively; the left guide bar and the right guide bar may be located in the left sliding groove and the right sliding groove respectively; the other side surface of the left armrest may be provided with a plurality of left positioning holes spaced apart from front to rear, and the other side surface of the right armrest may be provided with a plurality of right positioning holes spaced apart from front to rear; the dining tray may be provided with a left limiting groove and a right limiting groove; a left positioning rod and a right positioning rod may be provided in the left limiting groove and the right limiting groove respectively; one end of the left positioning rod passes through a left side of the dining tray to be located in a left positioning hole, and one end of the right positioning rod passes through a right side of the dining tray to be located in a right positioning hole; the dining tray may be provided with a pull plate for pulling the left positioning rod and the right positioning rod to move rightward and leftward respectively; a bottom of the pull plate may be provided with a pull portion; and the pull portion extends out of the bottom of the dining tray.

Further, an inner bottom surface of the dining tray may be provided with a third movement space; the pull plate may be located in the third movement space; a rear end of the pull plate may be provided with a left inclined groove and a right inclined groove; the left inclined groove and the right inclined groove may be arranged in a splayed shape; the other end of the left positioning rod may be provided with a left shaft hole; the left shaft hole may be located below and opposite to the left inclined groove; the other end of the left positioning rod may be connected to the pull plate via a connecting shaft passing through the left inclined groove and the left shaft hole; the other end of the right positioning rod may be provided with a right shaft hole; the right shaft hole may be located below and opposite to the right inclined groove; the other end of the right positioning rod may be connected to the pull plate via a connecting shaft passing through the right inclined groove and the right shaft hole; a plurality of second limiting posts and one positioning block may be provided in the third movement space; the pull plate may be provided with a plurality of second elongated limiting grooves; each of the second limiting posts may correspond to and be located in one second elongated limiting groove; the pull plate may be provided with a spring through-groove; the positioning block may be located in the spring through-groove; a third spring may be provided between a rear end surface of the positioning block and a rear inner side surface of the spring through-groove; the bottom of the dining tray may be provided with a hand accommodating chamber; and the pull portion may be located in the hand accommodating chamber.

Further, a bottom of the seat may be provided with a rotating shaft, a left movement groove and a right movement groove; two ends of the rotating shaft may be connected to the left sleeve member and the right sleeve member respectively; a second movable member may be provided in the left movement groove, and a third movable member may be provided in the right movement groove; the left sleeve member and the right sleeve member respectively extend rearward with a left connecting portion and a right connecting portion; a side surface of the left connecting portion and a side surface of the right connecting portion may be provided with a second insertion hole and a third insertion hole respectively; a left insertion rod may be provided at one end of the second movable member, and a right insertion rod may be provided at one end of the third movable member; the left insertion rod passes through a left side surface of the seat to be located in the second insertion hole; the right insertion rod passes through a right side surface of the seat to be located in the third insertion hole; the second movable member may be provided with a left spring groove; a left baffle and a third limiting post may be provided in the left movement groove; the left baffle may be located in the left spring groove; a fourth spring may be provided in the left spring groove; two ends of the fourth spring respectively abut against a left inner side wall of the left spring groove and the left baffle; the second movable member may be provided with a third elongated limiting groove; the third limiting post may be located in the third elongated limiting groove; the third movable member may be provided with a right spring groove; a right baffle and a fourth limiting post may be provided in the right movement groove; the right baffle may be located in the right spring groove; a fifth spring may be provided in the right spring groove; two ends of the fifth spring respectively abut against a right inner side wall of the right spring groove and the right baffle; the third movable member may be provided with a fourth elongated limiting groove; the fourth limiting post may be located in the fourth elongated limiting groove; and each of a bottom of the second movable member and a bottom of the third movable member may be provided with a protruding plate.

Further, each of a rear end of the left sleeve member and a rear end of the right sleeve member may be provided with a protruding portion; the protruding portion may be provided with a slot communicating with the left sleeve member and the right sleeve member respectively; a rear end surface of each of two vertical parts of the front support frame may be provided with a plurality of fourth insertion holes spaced apart from top to bottom; a second button hinged to the protruding portion may be provided in the slot; a lower front end of the second button may be provided with a second insert portion; the second insert portion may pass through the slot to be inserted into a fourth insertion hole; and a six spring may be provided between a front end of the second button and a front inner side surface of the slot.

Further, a left I-shaped groove and a right I-shaped groove may be provided on one side surface of the left armrest connecting rod and one side surface of the right armrest connecting rod respectively; a left side surface and a right side surface of the backrest may be provided with a left I-shaped insert portion and a right I-shaped insert portion respectively; and the left I-shaped insert portion and the right I-shaped insert portion may be inserted into the left I-shaped groove and the right I-shaped groove respectively.

According to the description of the present invention, compared with the prior art, the present invention has the following advantages. The present invention has a novel structure and clever design. The front support frame and the rear support frame are arranged in a foldable manner, the left armrest and the right armrest are arranged in a foldable manner, the dining tray is position-adjustable and detachable, the seat is rotatable, and the backrest is detachable. Based on the above design, the present invention greatly saves the storage space and reduces the occupied area.

DETAILED DESCRIPTION OF THE EMBODIMENTS

Figure 1:
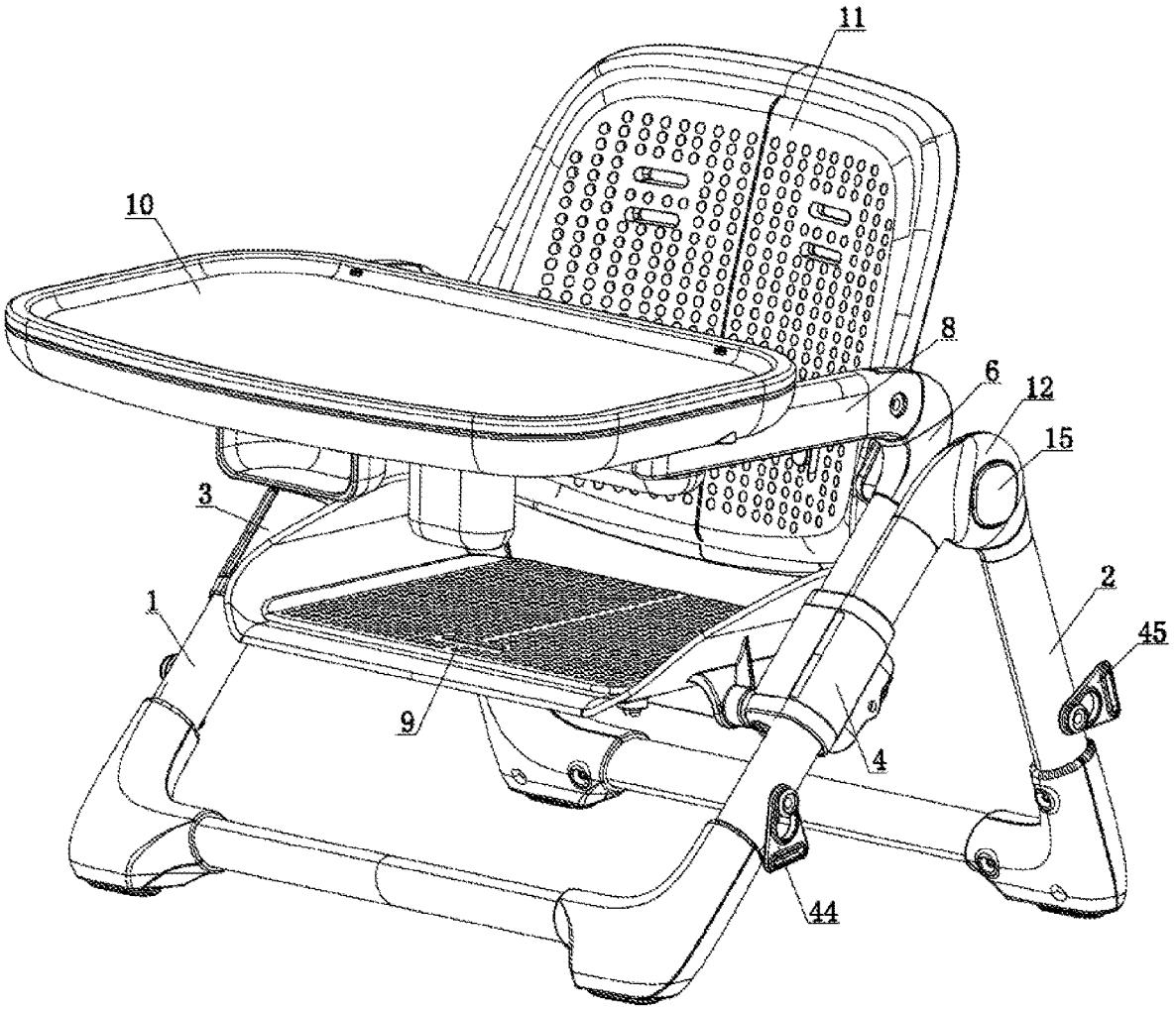
FIG. 1 is a structural view of a foldable small dining chair according to the present invention.

Referring to FIGS. 1, 2, 9 and 10, a foldable small dining chair includes a front support frame 1 and a rear support frame 2. The front support frame 1 and the rear support frame 2 are arranged in a foldable manner. The front support frame 1 is provided with a left sleeve member 3 and a right sleeve member 4. The front support frame 1 is provided with a left armrest connecting rod 5 and a right armrest connecting rod 6. A top front end of the left armrest connecting rod 5 is provided with a foldable left armrest 7, and a top front end of the right armrest connecting rod 6 is provided with a foldable right armrest 8. A rotatable seat 9 is provided between the left sleeve member 3 and the right sleeve member 4. A dining tray 10 being detachable and movable forwards and backwards is provided between the left armrest 7 and the right armrest 8. A detachable backrest 11 is provided between the left armrest connecting rod 5 and the right armrest connecting rod 6. The left sleeve member 3 and the right sleeve member 4 are respectively provided with a left sleeve hole 31 and a right sleeve hole 41. A bottom of the left armrest connecting rod 5 and a bottom of the right armrest connecting rod 6 are respectively nested in the left sleeve hole 31 and the right sleeve hole 41.

Referring to FIGS. 1, 6, 7 and 8, both the front support frame 1 and the rear support frame 2 are U-shaped. Each of top left and right ends of the front support frame 1 is provided with a front pivoting piece 12, and each of top left and right ends of the rear support frame 2 is provided with a rear pivoting piece 13. The front pivoting piece 12 is correspondingly hinged to the rear pivoting piece 13, and a first movement space is formed after the front pivoting piece 12 and the rear pivoting piece 13 are connected correspondingly. An engaging member 14 movable in left and right directions is provided in the first movement space. The engaging member 14 is engaged with the front pivoting piece 12 and the rear pivoting piece 13. One side surface of the front pivoting piece 12 is provided with a first button 15 for driving the engaging member 14 to move.

Referring to FIGS. 1, 6, 7 and 8, a plurality of engaging teeth 141 are provided on a periphery of the engaging member 14. The other side surface of the front pivoting piece 12 is provided with a first accommodating groove 121 and a plurality of first engaging grooves 122 distributed on a periphery of the first accommodating groove 121. the plurality of first engaging grooves 122 communicate with the first accommodating groove 121. A side surface of the rear pivoting piece 13 is provided with a second accommodating groove 131 and a plurality of second engaging grooves 132 distributed on a periphery of the second accommodating groove 131. the plurality of second engaging grooves 132 communicate with the second accommodating groove 131. The first accommodating groove 121 and the second accommodating groove 131 form the first movement space. the plurality of engaging teeth 141 are adapted to the plurality of first engaging grooves 122 and the plurality of second engaging grooves 132. In a use state, the plurality of engaging teeth 141 are simultaneously engaged with the plurality of first engaging grooves 122 and the plurality of second engaging grooves 132.

Referring to FIGS. 1, 6, 7 and 8, a button groove 16 adapted to the first button 15 is provided on one side surface of the front pivoting piece 12. The button groove 16 is provided with a plurality of through grooves 161 communicating with the first accommodating groove 121. A plurality of pressing pieces 17 are provided on one side surface of the first button 15. Each pressing piece 17 corresponds to one through groove 161. A hook portion 171 is provided at an end of each pressing piece 17. Each of the through grooves 161 is provided with an abutting edge portion 162. Each pressing piece 17 passes through a corresponding through groove 161, and the hook portion 171 abuts against the abutting edge portion 162. The end of each pressing piece 17 abuts against the engaging member 14. A first spring 18 is provided between the engaging member 14 and the second accommodating groove 131.

Referring to FIGS. 1, 6, 7 and 8, when the front support frame 1 and the rear support frame 2 need to be folded, the first buttons 15 on the front pivoting pieces 12 at the top left and right ends of the front support frame 1 are pressed. When the first buttons 15 are pressed, the engaging members 14 are driven to move, such that the engaging teeth 141 of the engaging member 14 are separated from the first engaging grooves 122. At this time, the front pivoting pieces 12 can be folded relative to the rear pivoting pieces 13, such that the front support frame 1 and the rear support frame 2 are folded.

Figure 2:
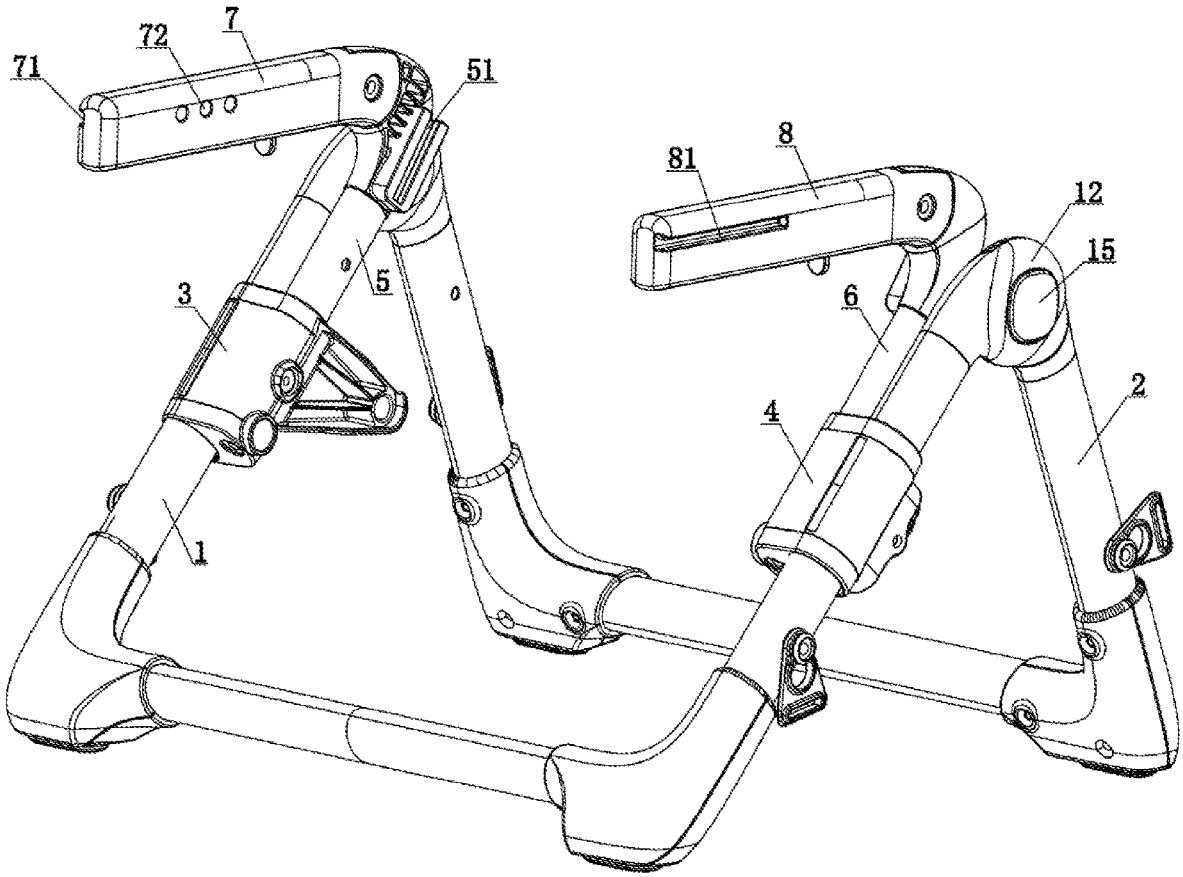
FIG. 2 is a partial view of the foldable small dining chair excluding a dining tray, a seat and a backrest according to the present invention.
Figure 3:
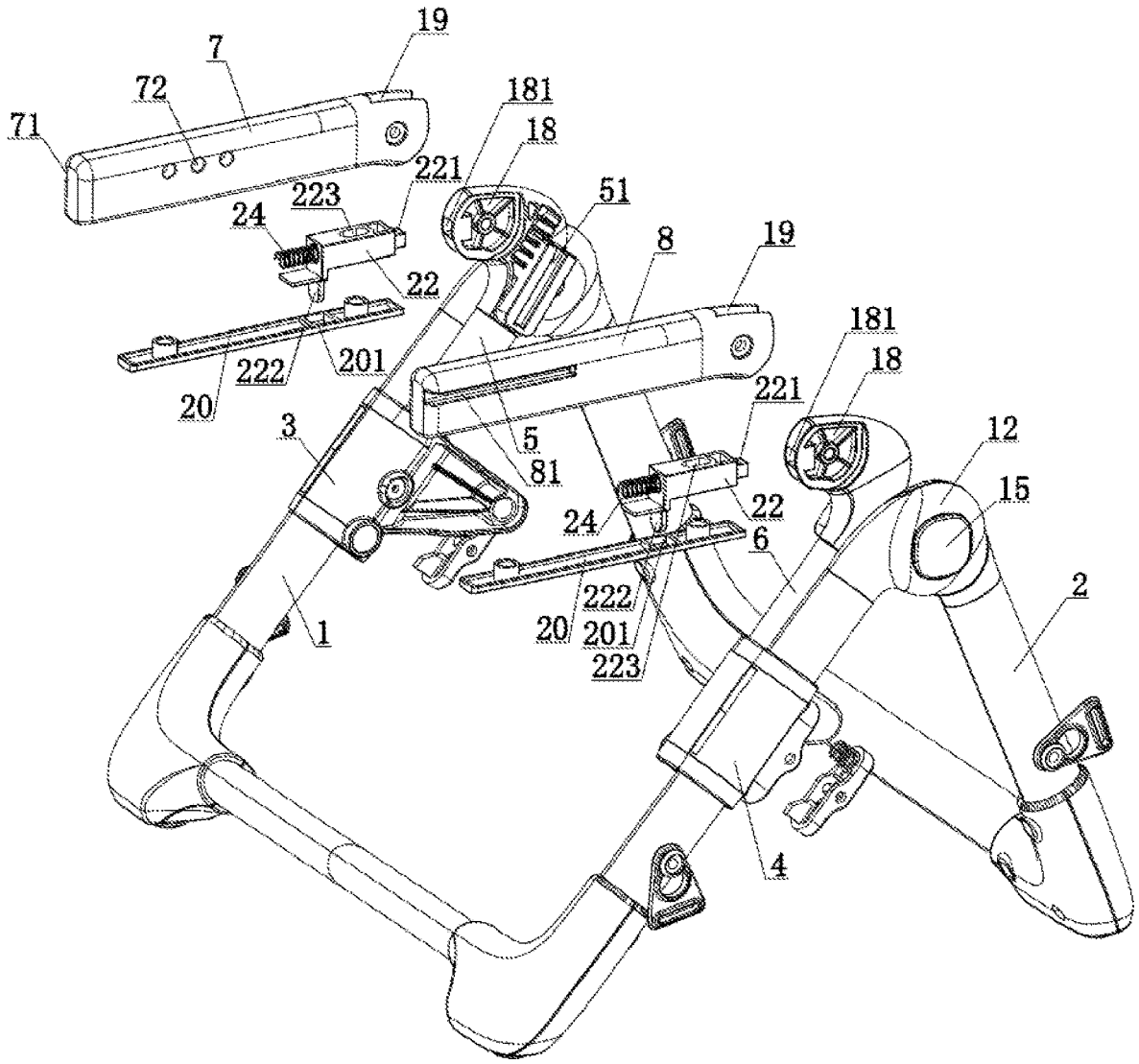
FIG. 3 is an exploded view of the structure shown in FIG. 2.
Figure 4:
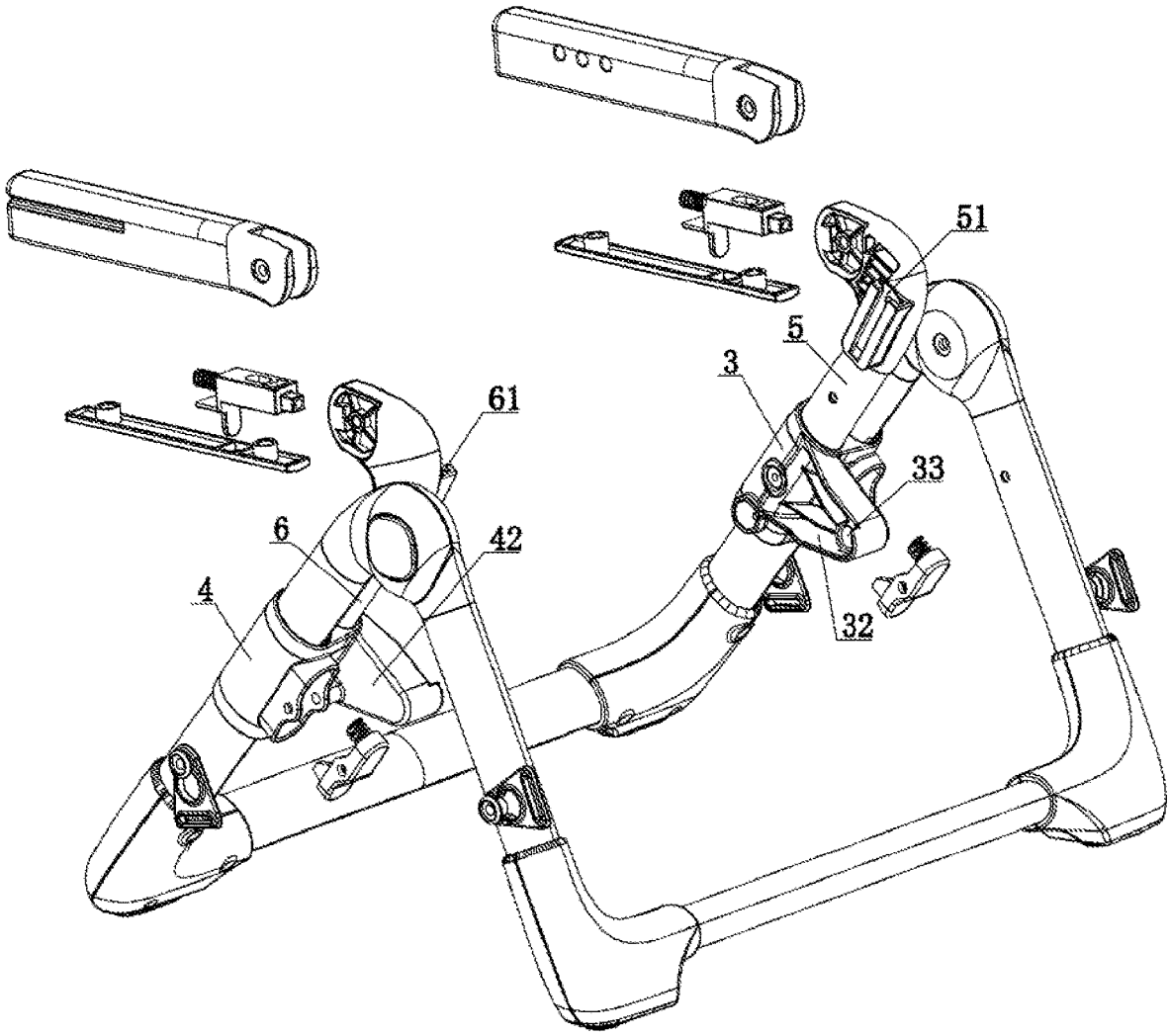
FIG. 4 is an exploded view of the structure shown in FIG. 2 from another angle.

Referring to FIGS. 2 and 3, each of a front top end of the left armrest connecting rod 5 and a front top end of the right armrest connecting rod 6 is provided with a hinge portion 18. Each of a rear end of the left armrest 7 and a rear end of the right armrest 8 is provided with a slit 19 adapted to the hinge portion 18. The hinge portion 18 is located in the corresponding slit 19 and hinged to the corresponding left armrest 7 or right armrest 8. A front end surface of the hinge portion 18 is provided with a first insertion hole 181. Each of a bottom of the left armrest 7 and a bottom of the right armrest 8 is provided with an opening. The opening is covered with a cover plate 20. Each of the left armrest 7 and the right armrest 8 is provided with a second movement space 21. A first movable member 22 is provided in the second movement space 21. A first insert portion 221 is provided at one end of the first movable member 22. The first insert portion 221 passes through the corresponding left armrest 7 or right armrest 8 to be inserted into the corresponding first insertion hole 181. A bottom of the first movable member 22 is provided with a pressing plate 222. A bottom of the cover plate 20 is provided with a movement through-groove 201. The pressing plate 222 is located in the movement through-groove 201.

Figure 5:
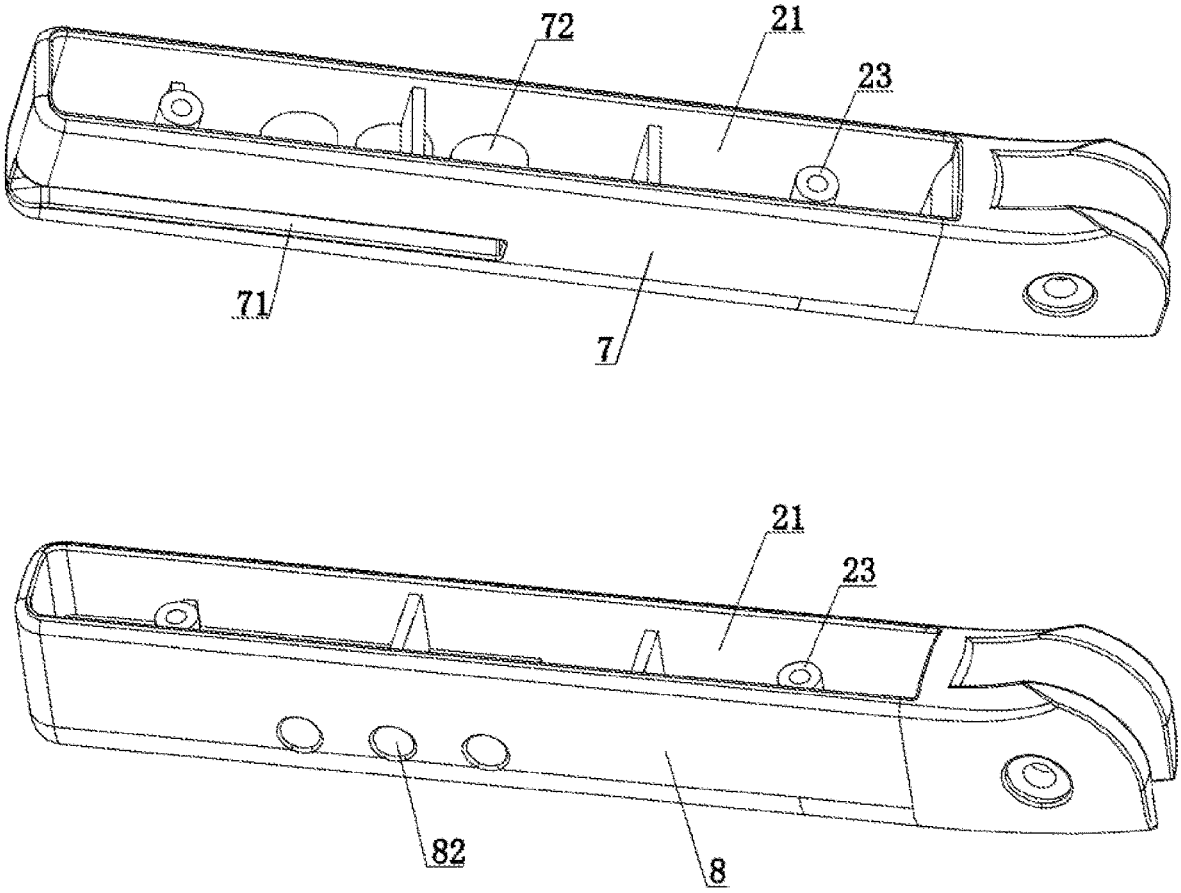
FIG. 5 is a structural view of a left armrest and a right armrest from another angle according to the present invention.
Figure 6:
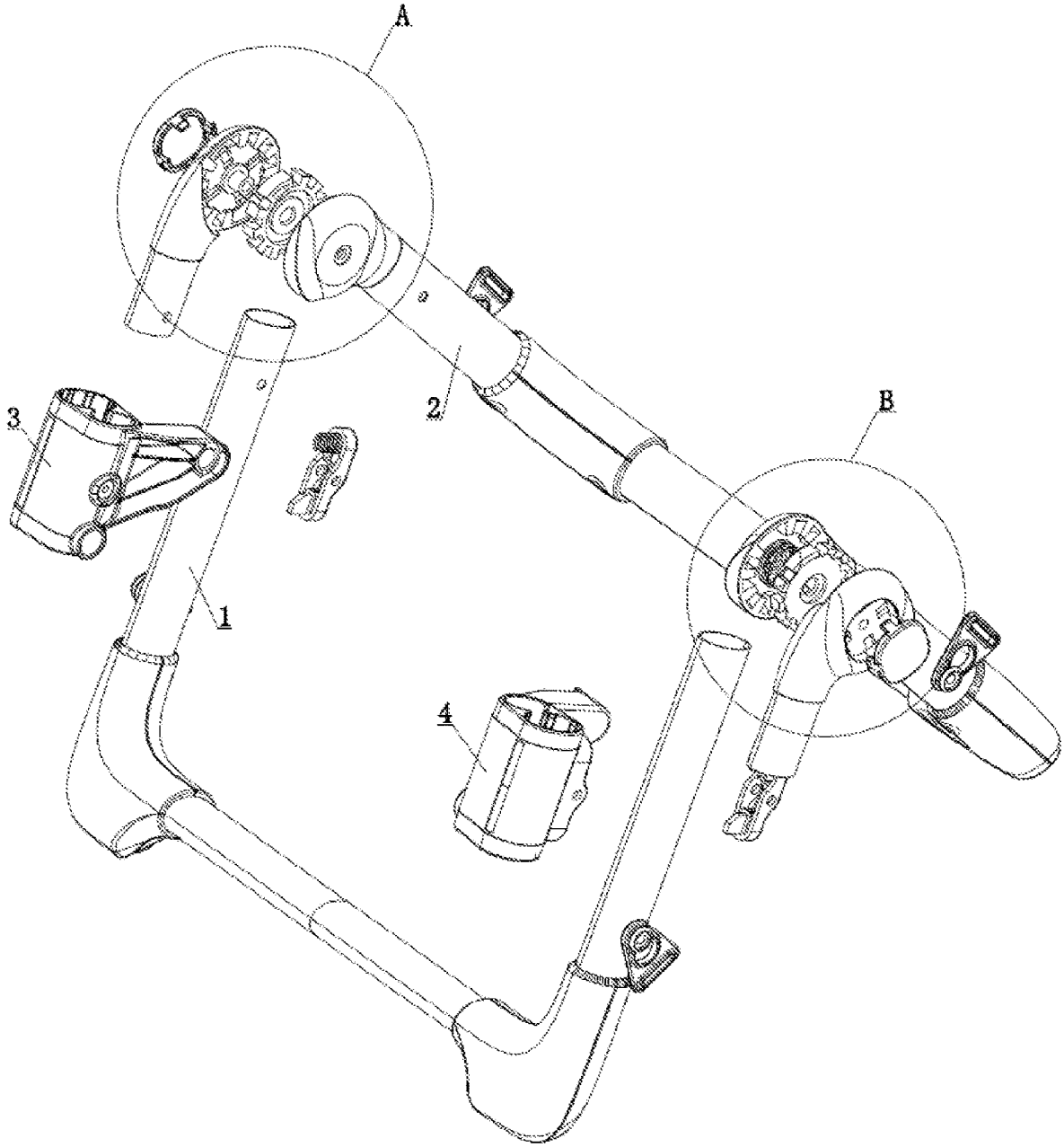
FIG. 6 is a partial exploded view of the structure shown in FIG. 2 excluding a left armrest connecting rod and a right armrest connecting rod.
Figure 7:
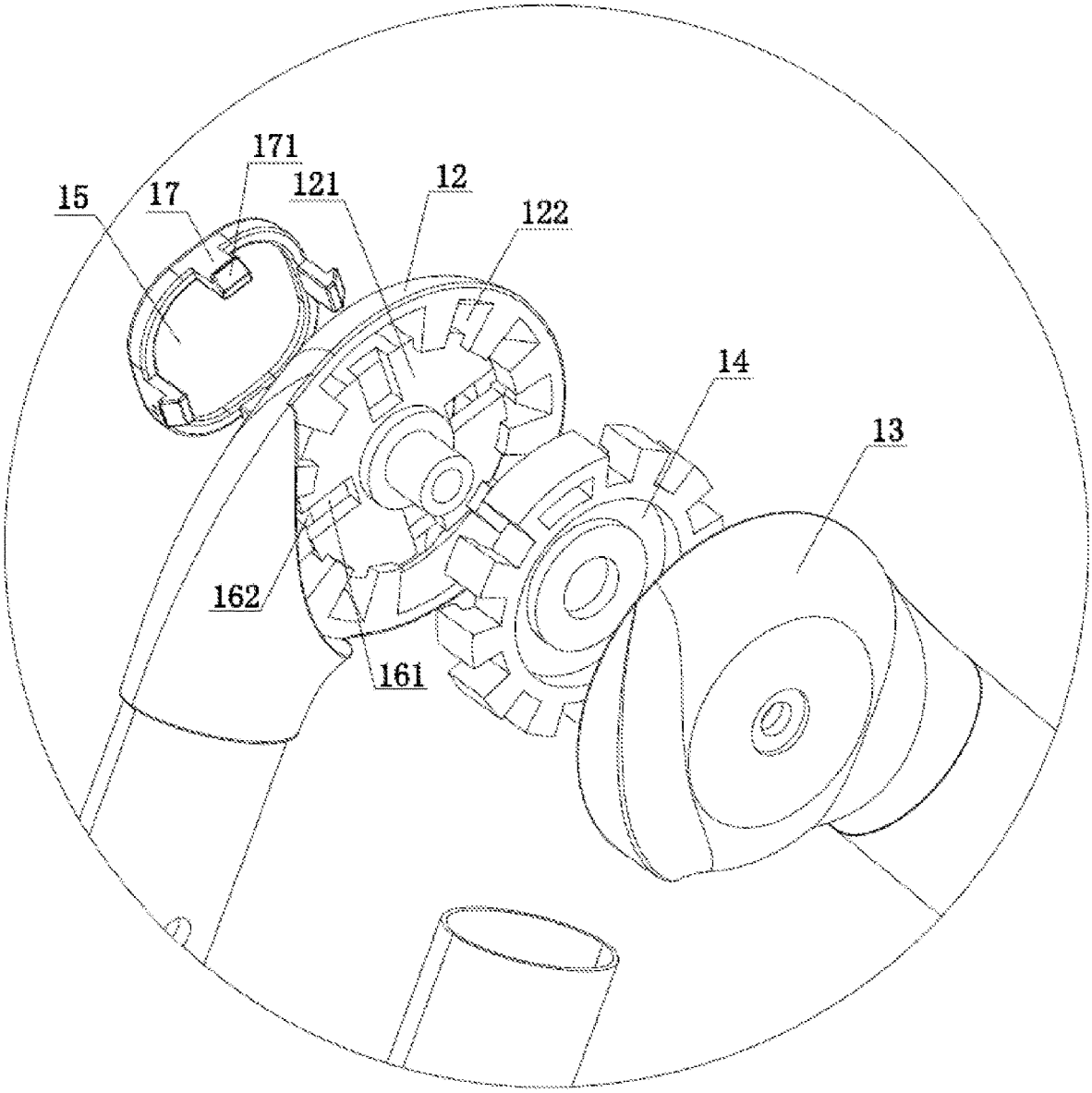
FIG. 7 is an enlarged view of A in FIG. 6.
Figure 8:
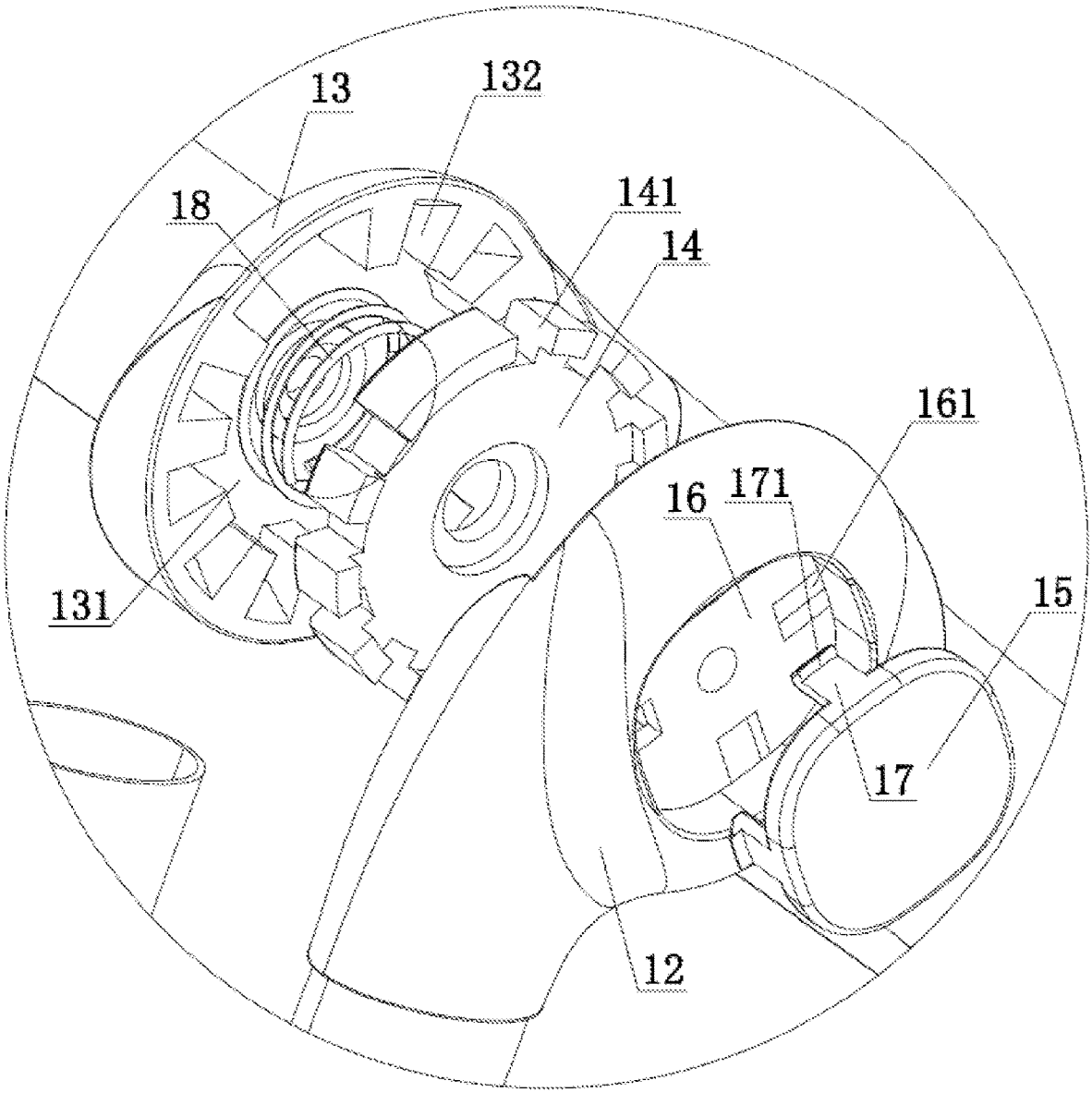
FIG. 8 is an enlarged view of B in FIG. 6.
Figure 9:
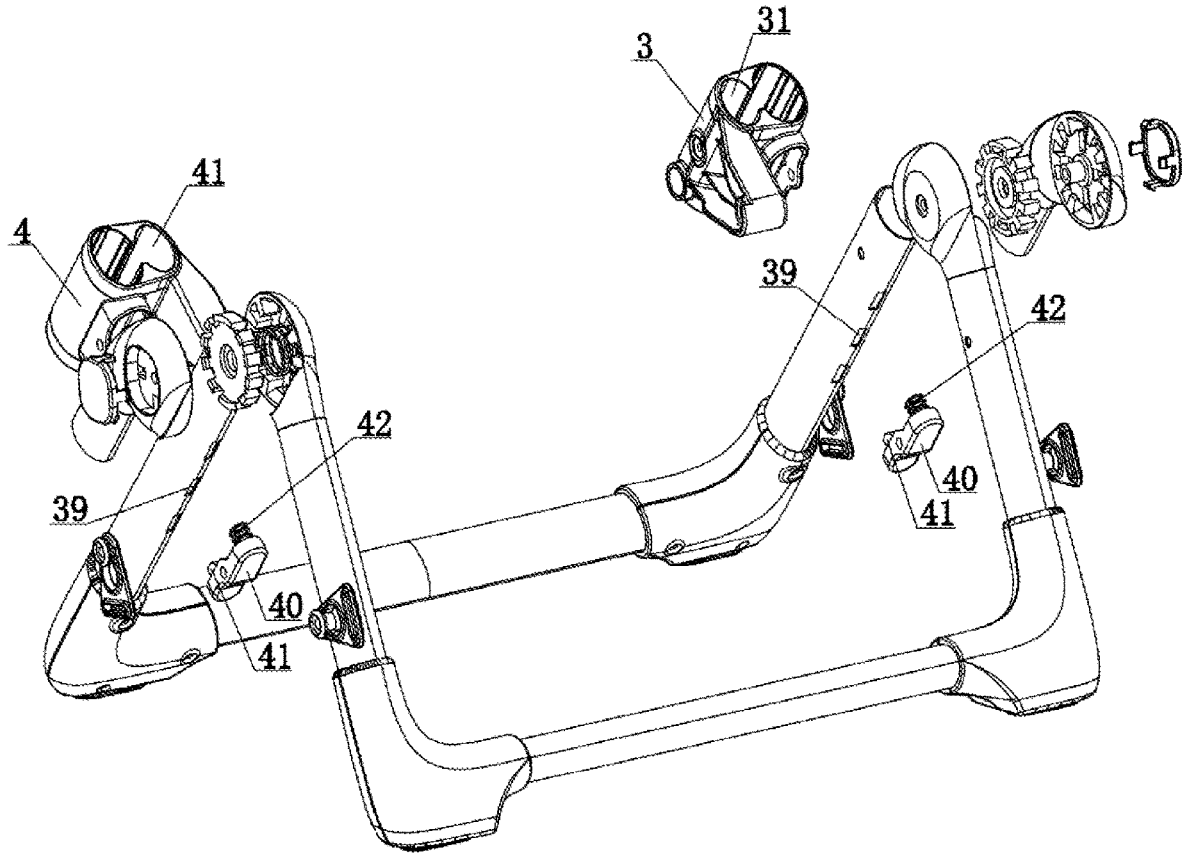
FIG. 9 is a view of the structure shown in FIG. 6 from another angle.
Figure 10:
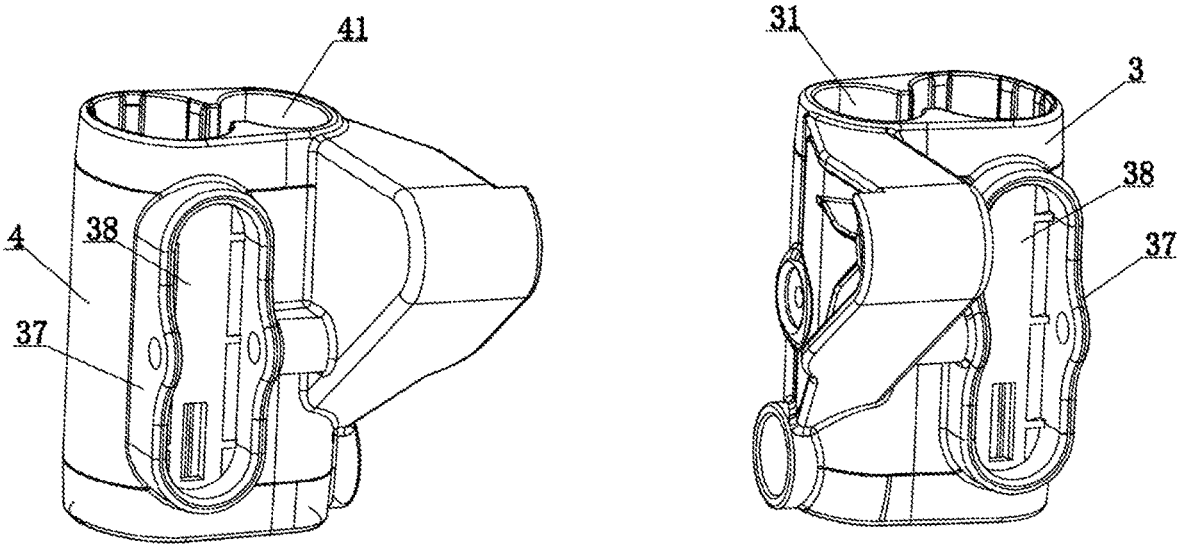
FIG. 10 is a structural view of a left sleeve member and a right sleeve member according to the present invention.
Figure 11:
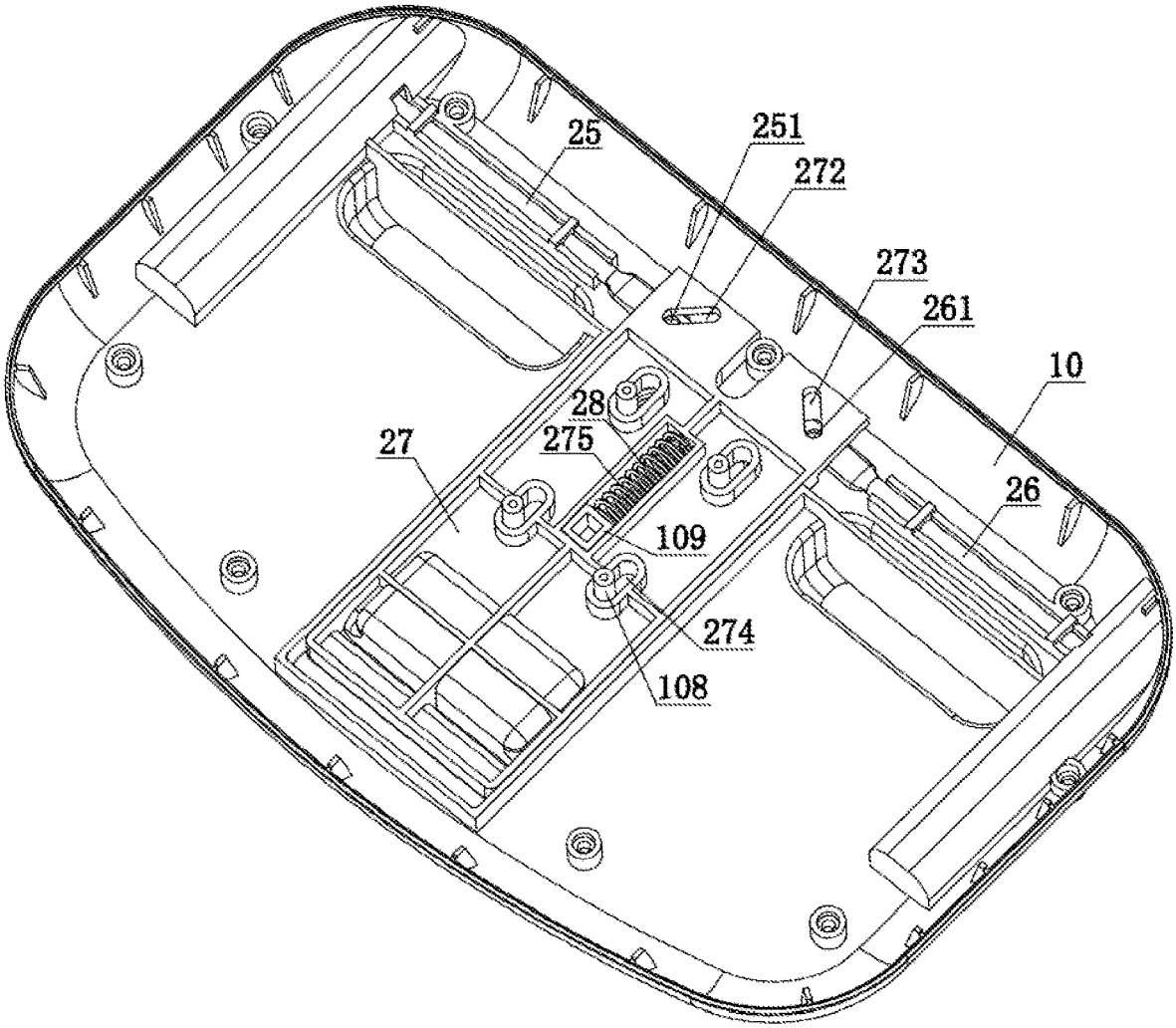
FIG. 11 is an interior view of the dining tray according to the present invention.
Figure 12:
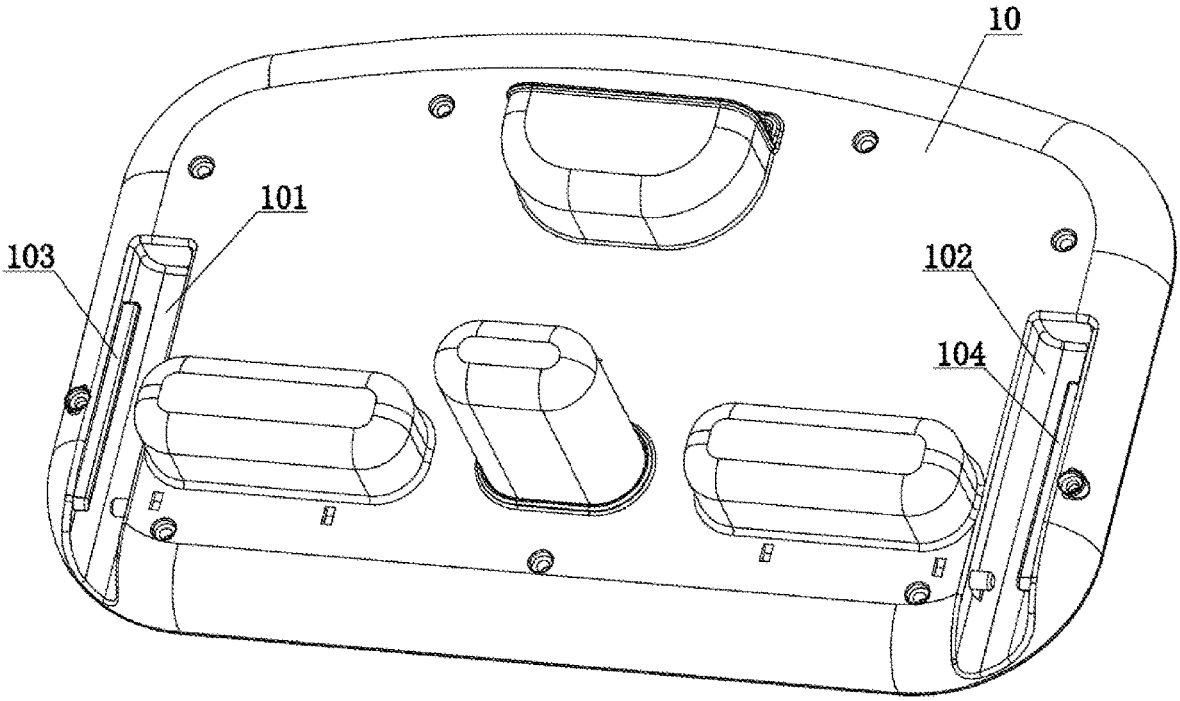
FIG. 12 is a structural view of the dining tray from another angle.
Figure 13:
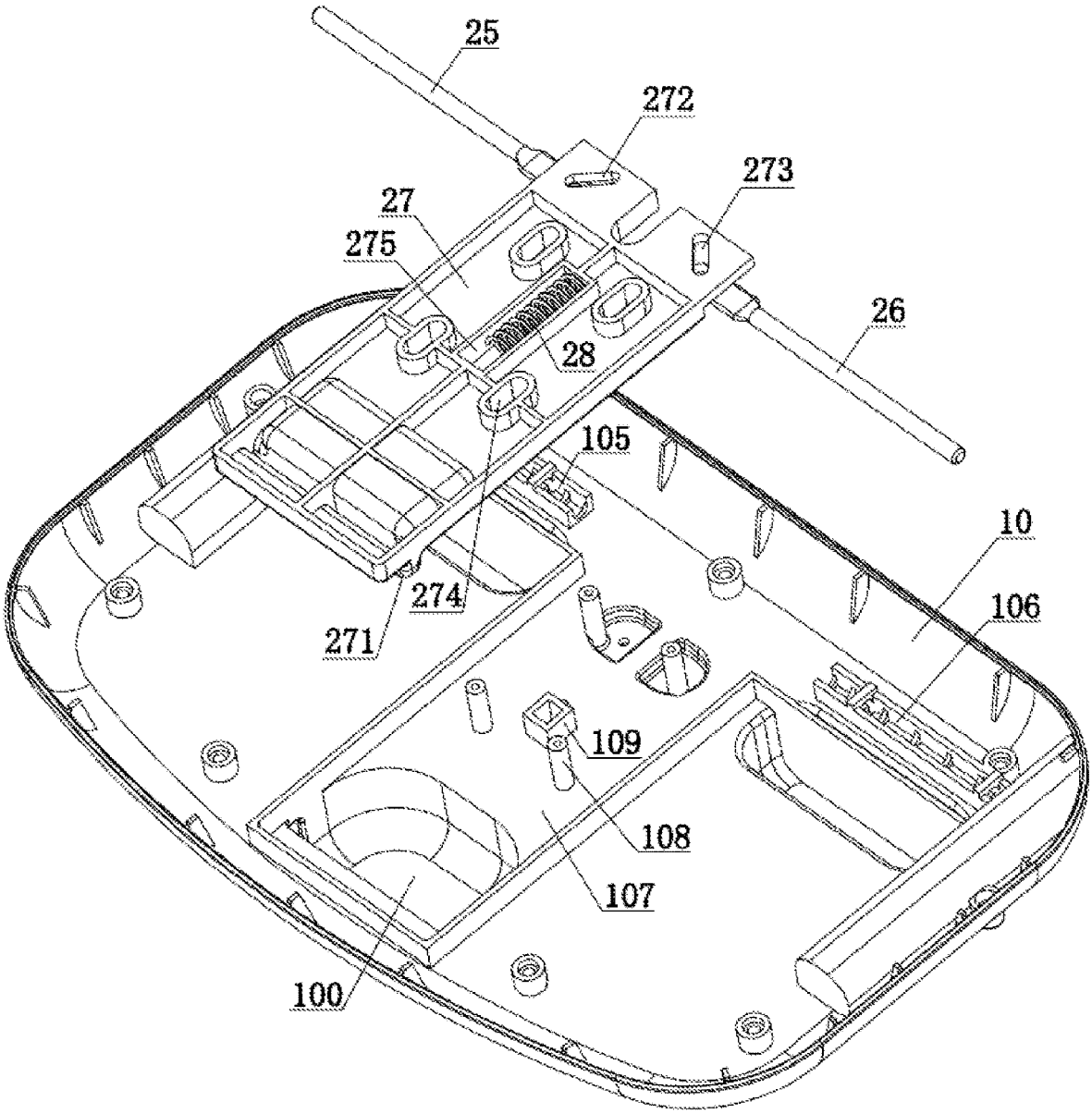
FIG. 13 is an exploded view of the structure shown in FIG. 11.
Figure 14:
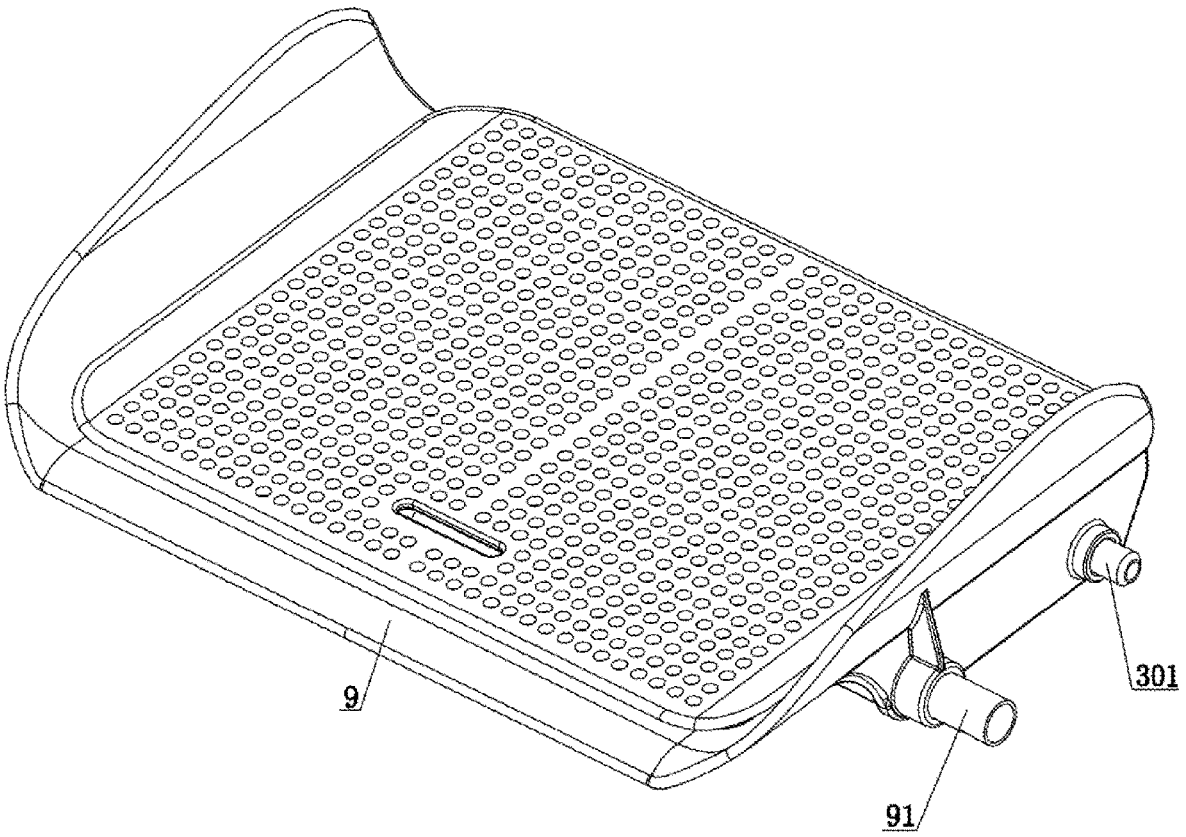
FIG. 14 is a structural view of the seat according to the present invention.
Figure 15:
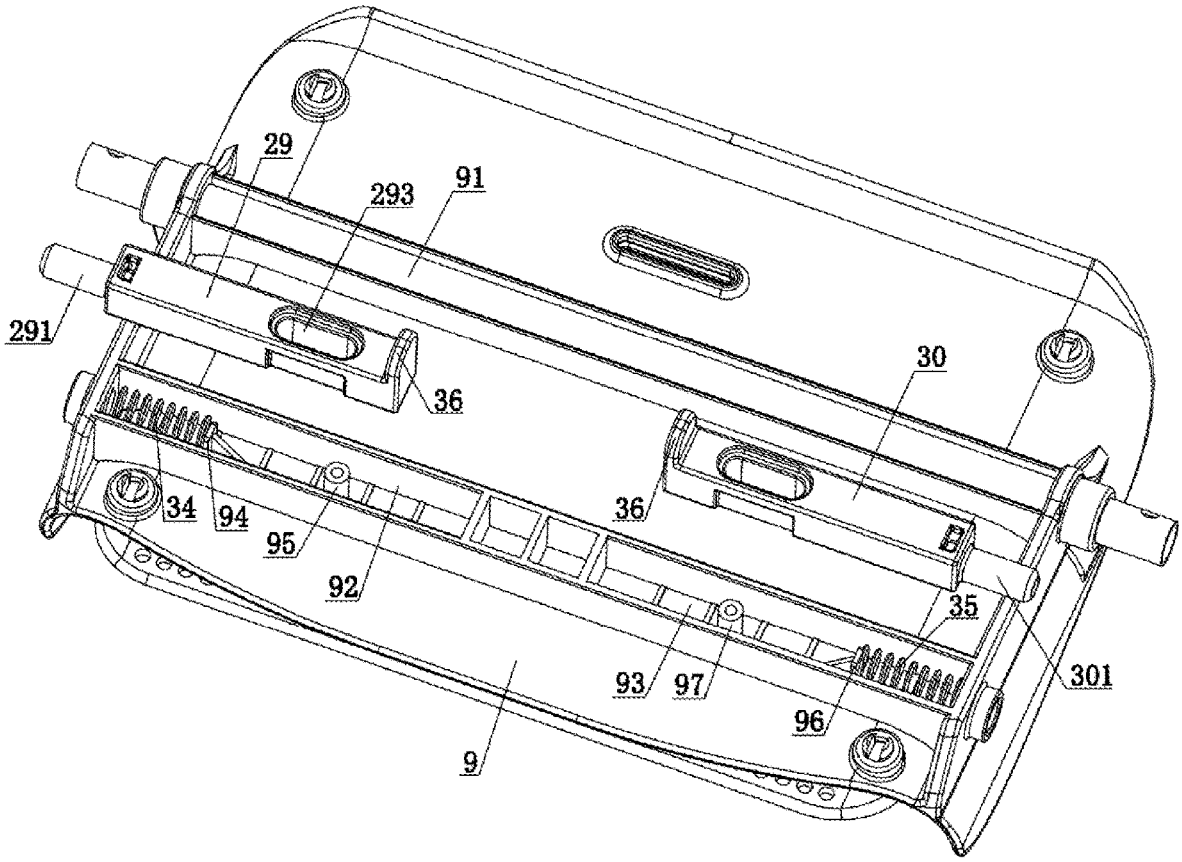
FIG. 15 is an exploded view of the seat from another angle.
Figure 16:
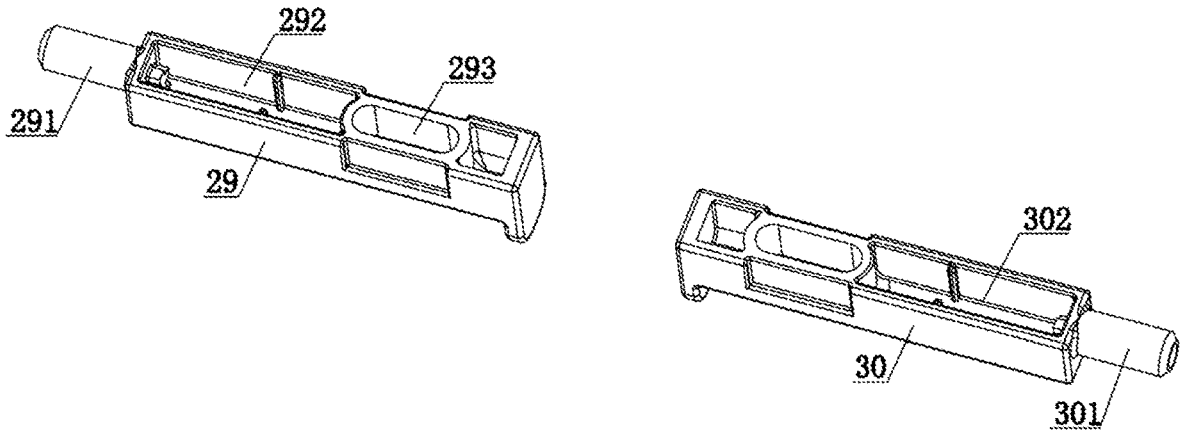
FIG. 16 is a structural view of a second movable member and a third movable member according to the present invention.
Figure 17:
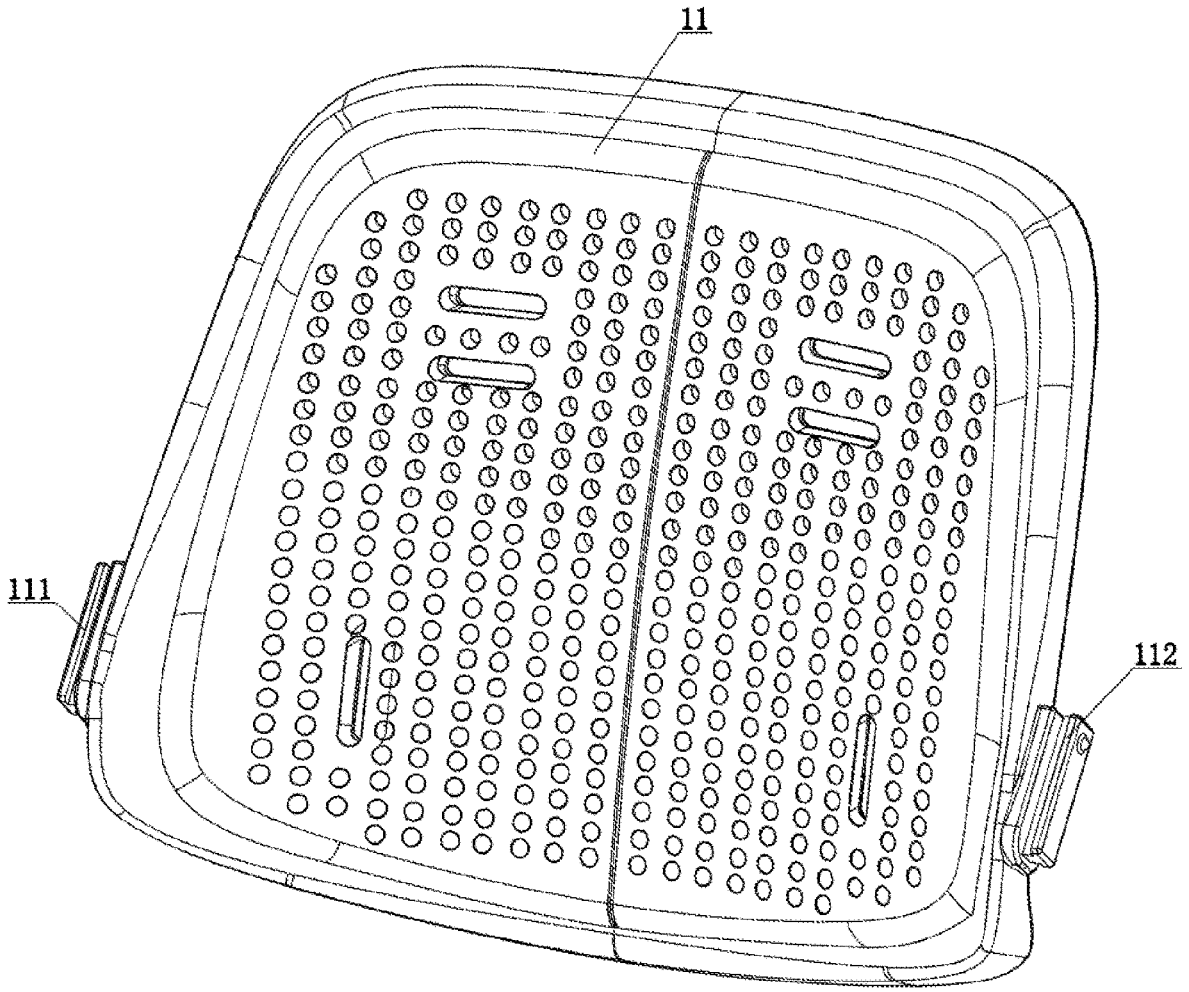
FIG. 17 is a view of the backrest according to the present invention.

Referring to FIGS. 2, 3 and 5, a first limiting post 23 is provided in the second movement space 21. The first movable member 22 is provided with a first elongated limiting groove 223. The first limiting post 23 is located in the first elongated limiting groove 223. A second spring 24 is provided between a front end of the first movable member 22 and a front inner wall of the second movement space 21.

Referring to FIGS. 2, 3 and 5, when the left armrest 7 and the right armrest 8 need to be folded, the pressing plates 222 of the first movable members 22 corresponding to the left armrest 7 and the right armrest 8 are pressed forward, such that the first movable members 22 move forward. After the first movable members 22 move forward, the first insert portions 221 are separated from the first insertion holes 181. Thus, the left armrest 7 and the right armrest 8 are rotatable and foldable relative to the corresponding hinge portions 18 respectively.

Referring to FIGS. 1, 2, 3, 5, 11. 12 and 13, a bottom of the dining tray 10 is provided with a left guide groove 101 and a right guide groove 102. A left sliding groove 71 and a right sliding groove 81 are provided on one side surface of the left armrest 7 and one side surface of the right armrest 8 respectively. One side surface of the left guide groove 101 and one side surface of the right guide groove 102 are provided with a left guide bar 103 and a right guide bar 104 respectively. An upper part of the left armrest 7 and an upper part of the right armrest 8 are located in the left guide groove 101 and the right guide groove 102 respectively. The left guide bar 103 and the right guide bar 104 are adapted to the left sliding groove 71 and the right sliding groove 81 respectively. The left guide bar 103 and the right guide bar 104 are located in the left sliding groove 71 and the right sliding groove 81 respectively. The other side surface of the left armrest 7 is provided with a plurality of left positioning holes 72 spaced apart from front to rear, and the other side surface of the right armrest 8 is provided with a plurality of right positioning holes 82 spaced apart from front to rear. The dining tray 10 is provided with a left limiting groove 105 and a right limiting groove 106. A left positioning rod 25 and a right positioning rod 26 are provided in the left limiting groove 105 and the right limiting groove 106 respectively. One end of the left positioning rod 25 passes through a left side of the dining tray 10 to be located in a left positioning hole 72, and one end of the right positioning rod 26 passes through a right side of the dining tray 10 to be located in a right positioning hole 82. The dining tray 10 is provided with a pull plate 27 for pulling the left positioning rod 25 and the right positioning rod 26 to move rightward and leftward respectively. A bottom of the pull plate 27 is provided with a pull portion 271. The pull portion 271 extends out of the bottom of the dining tray 10.

Referring to FIGS. 1, 2, 3, 5, 11. 12 and 13, an inner bottom surface of the dining tray 10 is provided with a third movement space 107. The pull plate 27 is located in the third movement space 107. A rear end of the pull plate 27 is provided with a left inclined groove 272 and a right inclined groove 273. The left inclined groove 272 and the right inclined groove 273 are arranged in a splayed shape. The other end of the left positioning rod 25 is provided with a left shaft hole 251. The left shaft hole 251 is located below and opposite to the left inclined groove 272. The other end of the left positioning rod 25 is connected to the pull plate 27 via a connecting shaft passing through the left inclined groove 272 and the left shaft hole 251. The other end of the right positioning rod 26 is provided with a right shaft hole 261. The right shaft hole 261 is located below and opposite to the right inclined groove 273. The other end of the right positioning rod 26 is connected to the pull plate 27 via a connecting shaft passing through the right inclined groove 273 and the right shaft hole 261. A plurality of second limiting posts 108 and one positioning block 109 are provided in the third movement space 107. The pull plate 27 is provided with a plurality of second elongated limiting grooves 274. Each of the second limiting posts 108 corresponds to and is located in one second elongated limiting groove 274. The pull plate 27 is provided with a spring through-groove 275. The positioning block 109 is located in the spring through-groove 275. A third spring 28 is provided between a rear end surface of the positioning block 109 and a rear inner side surface of the spring through-groove 275. The bottom of the dining tray 10 is provided with a hand accommodating chamber 100. The pull portion 271 is located in the hand accommodating chamber 100.

Referring to FIGS. 1, 2, 3, 5, 11. 12 and 13, the position of the dining tray 10 is adjustable. When the position of the dining tray 10 needs to be adjusted, the pull portion 271 is pulled to move the pull plate 27 forward. When the pull plate 27 moves forward, the left positioning rod 25 and the right positioning rod 26 are driven to move rightward and leftward respectively. As a result, one end of the left positioning rod 25 is separated from an originally matched left positioning hole 72, and one end of the right positioning rod 26 is separated from an originally matched right positioning hole 82. Thus, the position of the dining tray 10 can be adjusted. When the pull portion 271 is released, one end of the left positioning rod 25 and one end of the right positioning rod 26 are inserted into a new left positioning hole 72 and a new right positioning hole 82 respectively. When the dining tray 10 needs to be detached, the pull portion 271 is pulled to pull the dining tray 10 forward until the dining tray 10 is separated from the left armrest 7 and the right armrest 8.

Referring to FIGS. 1, 4, 14, 15 and 16, a bottom of the seat 9 is provided with a rotating shaft 91, a left movement groove 92 and a right movement groove 93. Two ends of the rotating shaft 91 are connected to the left sleeve member 3 and the right sleeve member 4 respectively. A second movable member 29 is provided in the left movement groove 92, and a third movable member 30 is provided in the right movement groove 93. The left sleeve member 3 and the right sleeve member 4 respectively extend rearward with a left connecting portion 32 and a right connecting portion 42. A side surface of the left connecting portion 32 and a side surface of the right connecting portion 42 are provided with a second insertion hole 33 and a third insertion hole (not shown in the figure) respectively. A left insertion rod 291 is provided at one end of the second movable member 29, and a right insertion rod 301 is provided at one end of the third movable member 30. The left insertion rod 291 passes through a left side surface of the seat 9 to be located in the second insertion hole 33. The right insertion rod 301 passes through a right side surface of the seat 9 to be located in the third insertion hole (not shown in the figure). The second movable member 29 is provided with a left spring groove 292. A left baffle 94 and a third limiting post 95 are provided in the left movement groove 92. The left baffle 94 is located in the left spring groove 292. A fourth spring 34 is provided in the left spring groove 292. Two ends of the fourth spring 34 respectively abut against a left inner side wall of the left spring groove 292 and the left baffle 94. The second movable member 29 is provided with a third elongated limiting groove 293. The third limiting post 95 is located in the third elongated limiting groove 293. The third movable member 30 is provided with a right spring groove 302. A right baffle 96 and a fourth limiting post 97 are provided in the right movement groove 93. The right baffle 96 is located in the right spring groove 302. A fifth spring 35 is provided in the right spring groove 302. Two ends of the fifth spring 35 respectively abut against a right inner side wall of the right spring groove 302 and the right baffle 96. The third movable member 30 is provided with a fourth elongated limiting groove 303. The fourth limiting post 97 is located in the fourth elongated limiting groove 303. Each of a bottom of the second movable member 29 and a bottom of the third movable member 30 is provided with a protruding plate 36.

Referring to FIGS. 1, 4, 14, 15 and 16, when the seat 9 needs to be rotated, the protruding plate 36 of the second movable member 29 is pushed rightward and the protruding plate 36 of the third movable member 30 is pushed leftward, such that the second movable member 29 and the third movable member 30 move rightward and leftward respectively. When the second movable member 29 and the third movable member 30 move rightward and leftward respectively, the left insertion rod 291 is separated from the second insertion hole 33, and the right insertion rod 301 is separated from the third insertion hole (not shown in the figure). Thus, the seat 9 can be rotated around the rotating shaft 91.

Referring to FIGS. 1, 2, 9 and 10, each of a rear end of the left sleeve member 3 and a rear end of the right sleeve member 4 is provided with a protruding portion 37. The protruding portion 37 is provided with a slot 38 communicating with the left sleeve member 3 and the right sleeve member 4 respectively. A rear end surface of each of two vertical parts of the front support frame 1 is provided with a plurality of fourth insertion holes 39 spaced apart from top to bottom. A second button 40 hinged to the protruding portion 37 is provided in the slot 38. A lower front end of the second button 40 is provided with a second insert portion 41. The second insert portion 411 passes through the slot 38 to be inserted into a fourth insertion hole 39. A sixth spring 42 is provided between a front end of the second button 40 and a front inner side surface of the slot 38. When the heights of the left armrest 7, the right armrest 8 and the dining tray 10 need to be adjusted, the upper parts of the second buttons 40 on the left sleeve member 3 and the right sleeve member 4 are pressed, such that the second insert portions 41 are separated from originally matched fourth insertion holes 39. Thus, the heights of the left sleeve member 3 and the right sleeve member 4 can be adjusted so as to adjust the heights of the left armrest 7, the right armrest 8 and the dining tray 10. When the second buttons 40 are released, the second insert portions 41 are inserted into new fourth insertion holes 39.

Referring to FIGS. 1, 2, 3 and 17, a left I-shaped groove 51 and a right I-shaped groove 61 are provided on one side surface of the left armrest connecting rod 5 and one side surface of the right armrest connecting rod 6 respectively. A left side surface and a right side surface of the backrest 11 are provided with a left I-shaped insert portion 111 and a right I-shaped insert portion 112 respectively. The left I-shaped insert portion 111 and the right I-shaped insert portion 112 are inserted into the left I-shaped groove 51 and the right I-shaped groove 61 respectively. When the backrest 11 needs to be detached, the backrest 11 is directly lifted up to separate the left I-shaped insert portion 111 and the right I-shaped insert portion 112 from the left I-shaped groove 51 and the right I-shaped groove 61 respectively.

Referring to FIG. 1, the front support frame 1 is provided with two front buckles 44, and the rear support frame 2 is provided with two rear buckles 45. The two front buckles 44 and the two rear buckles 45 are used for passing a tie rope. When the highchair is placed on an adult dining chair, the tie rope is used to tie the backrest of the adult dining chair.

Referring to FIG. 1, the design principle of the present invention is as follows. The front support frame 1 and the rear support frame 2 are arranged in a foldable manner, the left armrest 7 and the right armrest 8 are arranged in a foldable manner, the dining tray 10 is position-adjustable and detachable, the seat 9 is rotatable, and the backrest 11 is detachable. Based on the above design, the present invention greatly saves the storage space and reduces the occupied area.

The above described are merely specific implementations of the present invention, but the design concept of the present invention is not limited thereto. Any non-substantial changes made to the present invention based on the concept of the present invention should fall within the protection scope of the present invention.

What is claimed is:

1. A foldable small dining chair, comprising a front support frame and a rear support frame, wherein the front support frame and the rear support frame are arranged in a foldable manner; the front support frame is provided with a left sleeve member and a right sleeve member; the front support frame is provided with a left armrest connecting rod and a right armrest connecting rod; a top front end of the left armrest connecting rod is provided with a left armrest, and a top front end of the right armrest connecting rod is provided with a right armrest, wherein the left armrest and the right arm rest are foldable; a rotatable seat is provided between the left sleeve member and the right sleeve member; a dining tray being detachable and movable forwards and backwards is provided between the left armrest and the right armrest; and a detachable backrest is provided between the left armrest connecting rod and the right armrest connecting rod.

2. The foldable small dining chair according to claim 1, wherein the front support frame and the rear support frame are U-shaped; each of a top left end and a top right end of the front support frame is provided with a front pivoting piece, and each of a top left end and a top right end of the rear support frame is provided with a rear pivoting piece; the front pivoting piece is correspondingly hinged to the rear pivoting piece, and a first movement space is formed after the front pivoting piece and the rear pivoting piece are connected correspondingly; an engaging member movable in left and right directions is provided in the first movement space; the engaging member is engaged with the front pivoting piece and the rear pivoting piece; and a first side surface of the front pivoting piece is provided with a first button for driving the engaging member to move.

3. The foldable small dining chair according to claim 2, wherein a plurality of engaging teeth are provided on a periphery of the engaging member; a second side surface of the front pivoting piece is provided with a first accommodating groove and a plurality of first engaging grooves distributed on a periphery of the first accommodating groove; the plurality of first engaging grooves communicate with the first accommodating groove; a side surface of the rear pivoting piece is provided with a second accommodating groove and a plurality of second engaging grooves distributed on a periphery of the second accommodating groove; the plurality of second engaging grooves communicate with the second accommodating groove; the first accommodating groove and the second accommodating groove form the first movement space; the plurality of engaging teeth are adapted to the plurality of first engaging grooves and the plurality of second engaging grooves; and in a use state, the plurality of engaging teeth are simultaneously engaged with the plurality of first engaging grooves and the plurality of second engaging grooves.

4. The foldable small dining chair according to claim 3, wherein a button groove adapted to the first button is provided on the first side surface of the front pivoting piece; the button groove is provided with a plurality of through grooves communicating with the first accommodating groove; a plurality of pressing pieces are provided on one side surface of the first button; each pressing piece of the plurality of pressing pieces corresponds to one through groove; a hook portion is provided at an end of each pressing piece; each of the plurality of through grooves is provided with an abutting edge portion; each pressing piece passes through a corresponding through groove, and the hook portion abuts against the abutting edge portion; the end of each pressing piece abuts against the engaging member; and a first spring is provided between the engaging member and the second accommodating groove.

5. The foldable small dining chair according to claim 1, wherein the left sleeve member and the right sleeve member are respectively provided with a left sleeve hole and a right sleeve hole; and a bottom of the left armrest connecting rod and a bottom of the right armrest connecting rod are respectively nested in the left sleeve hole and the right sleeve hole.

6. The foldable small dining chair according to claim 1, wherein each of a front top end of the left armrest connecting rod and a front top end of the right armrest connecting rod is provided with a hinge portion; each of a rear end of the left armrest and a rear end of the right armrest is provided with a slit adapted to the hinge portion; the hinge portion is located in the slit and hinged to each of the left armrest and the right armrest; a front end surface of the hinge portion is provided with a first insertion hole; each of a bottom of the left armrest and a bottom of the right armrest is provided with an opening; the opening is covered with a cover plate; each of the left armrest and the right armrest is provided with a second movement space; a first movable member is provided in the second movement space; a first insert portion is provided at a first end of the first movable member; the first insert portion passes through each of the left armrest and the right armrest to be inserted into the first insertion hole; a bottom of the first movable member is provided with a pressing plate; a bottom of the cover plate is provided with a movement through-groove; and the pressing plate is located in the movement through-groove.

7. The foldable small dining chair according to claim 6, wherein a first limiting post is provided in the second movement space; the first movable member is provided with a first elongated limiting groove; the first limiting post is located in the first elongated limiting groove; and a second spring is provided between a second end of the first movable member and a front inner wall of the second movement space.

8. The foldable small dining chair according to claim 1, wherein a bottom of the dining tray is provided with a left guide groove and a right guide groove; a left sliding groove and a right sliding groove are provided on a first side surface of the left armrest and a first side surface of the right armrest respectively; one side surface of the left guide groove and one side surface of the right guide groove are provided with a left guide bar and a right guide bar respectively; an upper part of the left armrest and an upper part of the right armrest are located in the left guide groove and the right guide groove respectively; the left guide bar and the right guide bar are adapted to the left sliding groove and the right sliding groove respectively; the left guide bar and the right guide bar are located in the left sliding groove and the right sliding groove respectively; a second side surface of the left armrest is provided with a plurality of left positioning holes spaced apart from front to rear, and a second side surface of the right armrest is provided with a plurality of right positioning holes spaced apart from front to rear; the dining tray is provided with a left limiting groove and a right limiting groove; a left positioning rod and a right positioning rod are provided in the left limiting groove and the right limiting groove respectively; a first end of the left positioning rod passes through a left side of the dining tray to be located in a left positioning hole of the plurality of left positioning holes, and a first end of the right positioning rod passes through a right side of the dining tray to be located in a right positioning hole of the plurality of right positioning holes; the dining tray is provided with a pull plate for pulling the left positioning rod and the right positioning rod to move rightward and leftward respectively; a bottom of the pull plate is provided with a pull portion; and the pull portion extends out of the bottom of the dining tray.

9. The foldable small dining chair according to claim 8, wherein an inner bottom surface of the dining tray is provided with a third movement space; the pull plate is located in the third movement space; a rear end of the pull plate is provided with a left inclined groove and a right inclined groove; the left inclined groove and the right inclined groove are arranged in a splayed shape; a second end of the left positioning rod is provided with a left shaft hole; the left shaft hole is located below and opposite to the left inclined groove; the second end of the left positioning rod is connected to the pull plate via a first connecting shaft passing through the left inclined groove and the left shaft hole; a second end of the right positioning rod is provided with a right shaft hole; the right shaft hole is located below and opposite to the right inclined groove; the second end of the right positioning rod is connected to the pull plate via a second connecting shaft passing through the right inclined groove and the right shaft hole; a plurality of second limiting posts and one positioning block are provided in the third movement space; the pull plate is provided with a plurality of second elongated limiting grooves; each of the plurality of second limiting posts corresponds to and is located in one second elongated limiting groove of the plurality of second elongated limiting grooves; the pull plate is provided with a spring through-groove; the positioning block is located in the spring through-groove; a third spring is provided between a rear end surface of the positioning block and a rear inner side surface of the spring through-groove; the bottom of the dining tray is provided with a hand accommodating chamber; and the pull portion is located in the hand accommodating chamber.

10. The foldable small dining chair according to claim 1, wherein a bottom of the rotatable seat is provided with a rotating shaft, a left movement groove and a right movement groove; two ends of the rotating shaft are connected to the left sleeve member and the right sleeve member respectively; a second movable member is provided in the left movement groove, and a third movable member is provided in the right movement groove; the left sleeve member and the right sleeve member respectively extend rearward with a left connecting portion and a right connecting portion; a side surface of the left connecting portion and a side surface of the right connecting portion are provided with a second insertion hole and a third insertion hole respectively; a left insertion rod is provided at one end of the second movable member, and a right insertion rod is provided at one end of the third movable member; the left insertion rod passes through a left side surface of the rotatable seat to be located in the second insertion hole; the right insertion rod passes through a right side surface of the rotatable seat to be located in the third insertion hole; the second movable member is provided with a left spring groove; a left baffle and a third limiting post are provided in the left movement groove; the left baffle is located in the left spring groove; a fourth spring is provided in the left spring groove; two ends of the fourth spring respectively abut against a left inner side wall of the left spring groove and the left baffle; the second movable member is provided with a third elongated limiting groove; the third limiting post is located in the third elongated limiting groove; the third movable member is provided with a right spring groove; a right baffle and a fourth limiting post are provided in the right movement groove; the right baffle is located in the right spring groove; a fifth spring is provided in the right spring groove; two ends of the fifth spring respectively abut against a right inner side wall of the right spring groove and the right baffle; the third movable member is provided with a fourth elongated limiting groove; the fourth limiting post is located in the fourth elongated limiting groove; and each of a bottom of the second movable member and a bottom of the third movable member is provided with a protruding plate.

11. The foldable small dining chair according to claim 1, wherein each of a rear end of the left sleeve member and a rear end of the right sleeve member is provided with a protruding portion; the protruding portion is provided with a slot, wherein the slot communicates with the left sleeve member and the right sleeve member respectively; a rear end surface of each of two vertical parts of the front support frame is provided with a plurality of fourth insertion holes spaced apart from top to bottom; a second button hinged to the protruding portion is provided in the slot; a lower front end of the second button is provided with a second insert portion; the second insert portion passes through the slot to be inserted into a fourth insertion hole of the plurality of fourth insertion holes; and a sixth spring is provided between a front end of the second button and a front inner side surface of the slot.

12. The foldable small dining chair according to claim 1, wherein a left I-shaped groove and a right I-shaped groove are provided on one side surface of the left armrest connecting rod and one side surface of the right armrest connecting rod respectively; a left side surface and a right side surface of the detachable backrest are provided with a left I-shaped insert portion and a right I-shaped insert portion respectively; and the left I-shaped insert portion and the right I-shaped insert portion are inserted into the left I-shaped groove and the right I-shaped groove respectively.

* * * * *